United States Patent [19]

Fischer

[11] 4,418,443

[45] Dec. 6, 1983

[54] NOISE SUPPRESSOR FOR VACUUM SWEEPERS AND THE LIKE

[75] Inventor: Ernest J. Fischer, Skokie, Ill.

[73] Assignee: Breuer Electric Mfg. Co., Chicago, Ill.

[21] Appl. No.: 328,123

[22] Filed: Dec. 7, 1981

[51] Int. Cl.[3] ..... A47L 9/00

[52] U.S. Cl. ..... 15/326; 55/276; 55/379; 181/231; 181/250; 417/312

[58] Field of Search ..... 15/326; 55/276, 379; 417/312; 181/206, 231, 249, 250, 255, 273

[56] References Cited

U.S. PATENT DOCUMENTS

| | | | |
|---|---|---|---|
| 1,874,326 | 8/1932 | Mason | 181/255 |
| 2,125,850 | 8/1938 | Norris | 15/326 |
| 2,342,905 | 2/1944 | Smellie | 15/326 X |
| 2,730,188 | 1/1956 | Bailey | 181/255 |
| 2,903,085 | 8/1959 | Miller | 181/255 |
| 3,790,986 | 2/1974 | Burger | 15/328 |
| 4,315,558 | 2/1982 | Katayama | 181/255 X |

*Primary Examiner*—Chris K. Moore

*Attorney, Agent, or Firm*—Gary, Juettner & Pyle

[57] ABSTRACT

A noise suppressor for vacuum cleaners is characterized by a muffler formed of a succession of tubes of different cross sectional areas and lengths. The muffler defines a low pass acoustic filter, and is connected in line with an exhaust outlet from the vacuum cleaner. Preferably, the muffler is used in place of a sleeve conventionally found in a filter bag for the vacuum cleaner, and thereby acts as a stand pipe to maintain the inlet to the filter bag above collected debris so that the inlet is not choked off with debris before the bag is filled.

15 Claims, 2 Drawing Figures

NOISE SUPPRESSOR FOR VACUUM SWEEPERS AND THE LIKE

BACKGROUND OF THE INVENTION

The present invention relates to reduction of noise levels associated with exhausting air from devices employing blowers or fans, and in particular to a muffler adapted for use with vacuum sweepers, floor scrubbers, carpet maintenance equipment, blowers and the like.

Appliances utilizing high speed fans to move air, such for example as vacuum cleaners and blowers, typically produce high frequency sounds emanating from the air exhaust outlet and attending the passage of air through the fan chamber. Ordinarily, given the same sound pressure level, high frequency sounds are more annoying than low frequency sounds.

Noise levels can be reduced by installing equipment such as dampeners or mufflers at the exhaust outlet from the air motor. The exhaust outlet of a vacuum cleaner, employing a fan system through which passes debris entrained in air, is provided with an enclosure to capture the debris. The enclosure is usually made of a porous material and called a filter bag, so that air entering the enclosure may pass therethrough while debris is contained. When the filter bag is mounted in a location above the air motor, as for example in upright and external canister vacuum cleaners, it contains a tubular sleeve which attaches to the vacuum cleaner exhaust outlet. The function of the sleeve is to act as a stand pipe to keep the bag inlet above collected debris, so that debris does not choke off the inlet to the bag before the bag is full.

Conventional filter bags do little to reduce high frequency noises attending the passage of air at high velocity. The art therefore contemplates various muffling techniques to reduce the level of such noises, and in U.S. Pat. No. 2,130,495 a muffler for a vacuum cleaner extends from the exhaust outlet to an upper portion of a filter bag and comprises inner and outer tubular cloth sleeves having a tubular felt sleeve therebetween. In U.S. Pat. No. 2,287,867 a muffler for a vacuum cleaner comprises a short tubular section of sponge rubber positioned between the exhaust outlet and an inlet to a filter bag, and U.S. Pat. No. 4,015,683 teaches a somewhat similar foam material muffler, except that the flow path through the muffler comprises a central passageway having a plurality of radially extending grooves. In all of the aforementioned mufflers, the cellular texture of the muffler surface has the property of absorbing some volume of the noises in the air, and to that extent contributes to a greater quietness of operation. However, a disadvantage of such mufflers is that they tend to be rendered entirely useless or experience a significant decrease in efficiency within a short period of time as a result of the interstices in the cellular surfaces becoming filled with debris.

OBJECTS OF THE INVENTION

An object of the present invention is to provide an improved muffler for reducing high frequency noises attending high velocity movement of air in vacuum cleaners, carpet maintenance equipment, blowers and the like.

Another object is to provide such a muffler which may readily form a portion of a filter bag into which is introduced a high velocity flow of debris carrying air.

A further object is to provide such a muffler which does not experience with use decreases in noise reduction efficiency.

SUMMARY OF THE INVENTION

In accordance with the present invention, there is provided in combination with an enclosure for connection with an exhaust outlet from an air blower, wherein the enclosure has means for exhausting air introduced therein, a sound reducing muffler comprising a generally tubular housing having a generally cylindrical medial section of enlarged cross sectional area. The housing is connectable at one end with the exhaust outlet from the air blower and extends at an opposite end to interior of the enclosure for conveying air from the blower into the enclosure, the muffler acting as a low pass noise filter to reduce high frequency noises attending passage of air through the blower.

In a preferred embodiment, the enclosure comprises a filter bag, the muffler is substantially positioned within the filter bag, and the opposite end of the muffler housing extends toward an upper end of the filter bag to maintain an inlet thereto above any collected debris therein so that the inlet does not become choked off with debris.

The foregoing and other objects, advantages and features of the invention will become apparent upon a consideration of the following detailed description, when taken in conjunction with the accompanying drawings.

DETAILED DESCRIPTION

Figure 1:
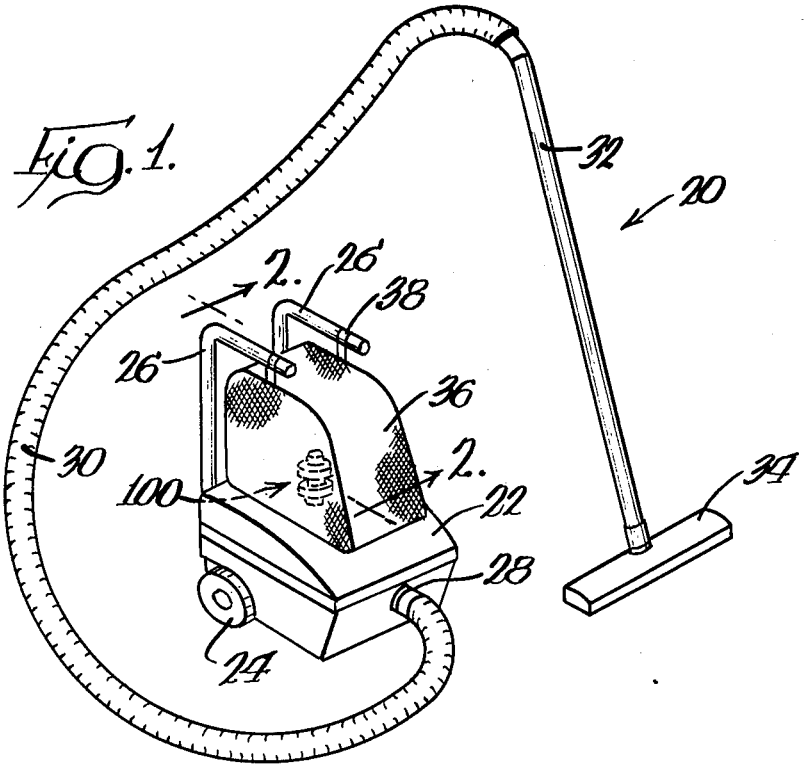
FIG. 1 is a perspective view of an external canister type vacuum cleaner, embodying a high frequency noise muffler in accordance with the teachings of the present invention.

FIG. 1 illustrates a canister type vacuum cleaner, indicated generally at 20, with which the teachings of the invention may advantageously be used. The vacuum cleaner includes a lower base or housing 22, which is provided with a pair of wheels 24 and handles 26 for ease of transport to points of use. An inlet 28 to the base connects through a hose 30 to one end of a tubular extension 32, the opposite end of which carries a floor and/or carpet cleaning attachment 34. An enclosure shown as a filter bag 38 for receiving debris laden air is carried atop the base, and may conveniently be supported in position by a pair of hooks 38 looped over the handles.

Figure 2:
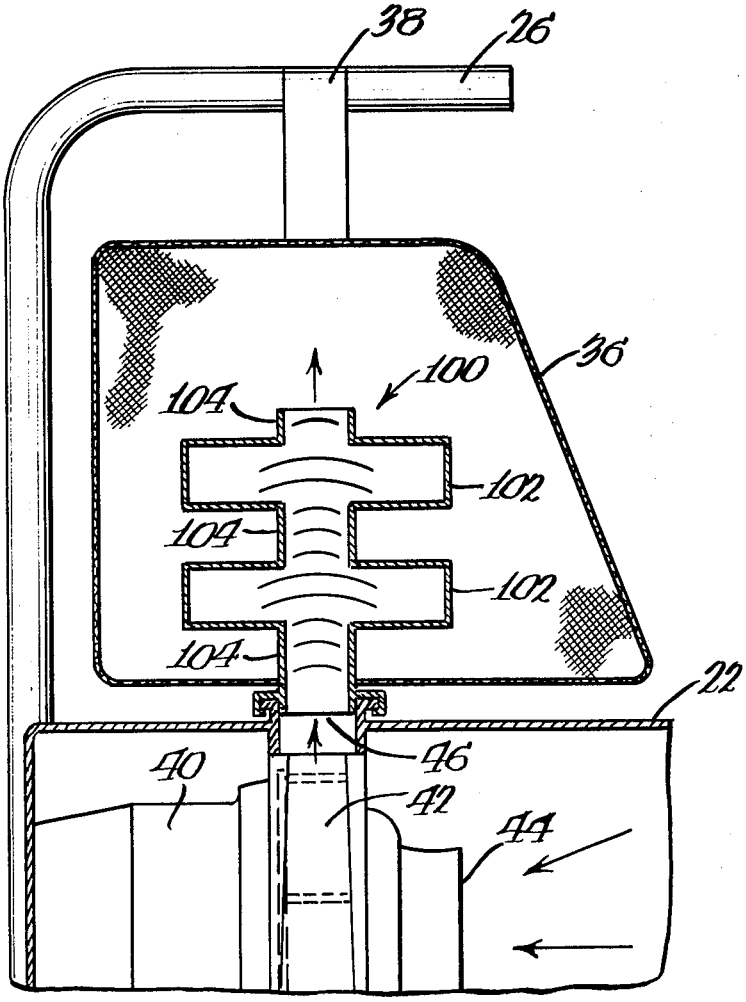
FIG. 2 is a cross sectional, side elevation view taken substantially along the lines 2—2 of FIG. 1, particularly illustrating the configuration of the muffler.

Referring also to FIG. 2, to provide suction at the attachment 3 to remove dirt and debris from a surface to be cleaned, a motor 40 and blower 42 are mounted within the base 22. The blower has an inlet 44 in communication with the interior of the base and an exhaust outlet 46 for connection with the interior of the filter bag 36. The motor drives the blower to generate suction at the attachment 34 to pick up dirt and debris, which is then carried in a high velocity flow of air through the tubular extension 32, the hose 30 and the blower into the interior of the filter bag. The illustrated filter bag is of a porous filter material, so that air escapes through the walls thereof while debris is captured and contained. It is understood, however, that other types of debris containing enclosures may be used in place of a porous filter bag, for example those of a type having nonporous walls with other means being provided for escape of air.

As is known, vacuum cleaners utilizing high speed fans to move air typically produce high frequency sounds, which sounds are more annoying and objectionable to a user than lower frequency sounds. Also, for an external canister vacuum cleaner of the type shown, as well as for an upright vacuum cleaner or any other type in which the filter bag is mounted above the exhaust from the air motor, a tubular sleeve is usually provided in the bag and extends between the exhaust outlet and a point toward the top of the bag to act as a stand pipe which prevents collected debris from choking off the inlet to the bag before the bag is full. The present invention provides a muffler for decreasing high frequency noises associated with movement of air through the vacuum cleaner, which at the same time serves the purpose of and replaces a sleeve in the filter bag to prevent collected debris from choking off the inlet to the bag.

Referring in particular to FIG. 2, the combination noise muffler and filter bag sleeve contemplated by the invention is indicated generally at 100 and comprises a low pass noise filter which reduces the intensity of high frequency sound waves passing therethrough. The muffler is comprised of a tubular housing having one or more generally cylindrical medial sections of enlarged cross sectional area, which together with the remainder of the housing define a succession of tubes with different cross sectional areas, for example relatively large cross sectional area tubes 102 and relatively small cross sectional area tubes 104 arranged in series to alternate the tubes 102 and 104.

As can be seen from FIG. 2, each of the larger tubes 102 is formed by a cylindrical wall of a first diameter, and each of the smaller tubes 104 is formed by a tubular member of a second diameter; with adjacent tubes 102 and 104 being connected by planar end walls extending from the circumference of the tube 102 perpendicular to the axis thereof inwardly to openings coaxial with the axis of tube 102 equal to the second diameter of tube 104. An inlet to the lowermost tube 104 connects with the exhaust outlet 46 from the blower 42 and an outlet from the uppermost tube 104 opens into an upper portion of the filter bag 36 and defines the inlet to the bag. The ratio of the cross sectional areas of the tubes to each other and to the length of the tubes determines the frequency range of sound that is passed through the muffler, and by choosing appropriate dimensions high frequency noises may be appreciably reduced at the exhaust outlet. At the same time, since a muffler of the type described operates without internal restriction, it may be used in place of the aforementioned filter bag sleeve. Thus, a functional filter bag provided with the muffler 100 can reduce noise without the need for additional components.

As is apparent, the muffler 100 is, in its most primitive form, a simple expansion chamber which acts as a low pass filter. The effectiveness of the muffler is determined by its noise transmission loss (L) in decibels, which is defined as 10 times the logarithm to the base 10 of the ratio and sound power incident on the muffler to sound power transmitted by the muffler. Considering only a single one of the relatively large cross sectional area tubes 102, which may be considered as an expansion chamber, along with the two relatively small cross sectional tubes 104 on its opposite sides, the noise transmission loss or decrease in the level of sound passing through the three tubes may be determined by the following equation:

$$L = 10 \log [1 + \tfrac{1}{4}(m - 1/m)^2 \sin^2(kl)] \text{ dB where:}$$

$$m = \frac{\text{cross sectional area of tube 102}}{\text{cross sectional area of tube 104}} = \frac{S_2}{S_1},$$

$l$ = length of tube 102 in feet, $$k = \frac{2\pi}{\lambda},$$

$$\lambda = \text{sound wavelength} = \frac{1130}{f}\sqrt{\frac{\theta_F + 460}{530}} \text{ feet,}$$

$f$ = frequency of sound waves in Hz, and $\theta_F$ = muffler temperature in °F.

In essence, the performance of the muffler 100 may be interpreted in terms of the sound wave system existing inside the muffler. Reflected sound waves inside the muffler interfere destructively with incident waves at the inlet to the muffler, and thus provide a mismatch of impedance between the interior of the muffler and the inlet thereto, leading to reflection of sound energy back along the inlet toward the source of the sound.

Although the foregoing discussion was limited to a single expansion chamber or relatively large cross sectional area tube 102 connected in series with two relatively small cross sectional area tubes 104, it may be extended to include two or more expansion chambers in series, for example the two tubes 102 and the three tubes 104 as shown. As the number of expansion chambers increases, the transmission loss L and the effectiveness of the muffler increases. The transmission loss L also increases at the lengths of the tubes separating the expansion chambers increase. Thus, by an appropriate selection of the number of tubes 102 and 104, along with a selection of the ratios of the cross sectional areas of the tubes and their lengths, the transmission loss of the muffler and the frequency range of sound passed therethrough may be determined and controlled. It is appreciated, however, that additional expansion chambers 102 and long separating tubes 104 tend to increase the size of the muffler, so that for practical purposes some compromises in effectiveness may be necessary.

The invention thus provides an improved noise filter or muffler for vacuum cleaners. By virtue of the muffler serving in place of a sleeve otherwise required in a filter bag for a vacuum cleaner, the muffler may be efficiently incorporated into the bag without need for additional components. Although the muffler may be separate from the filter bag and the bag positioned therearound in use, it is advantageously formed as part of the bag itself, just as a sleeve would be formed as part of the bag, so that no special care need be taken in mounting the bag on the vacuum cleaner. Of course, if it were desired to do so, the muffler could be separate from the filter bag and positioned between the bag and vacuum cleaner exhaust outlet, although that would necessitate provision of a separate sleeve in the bag where the bag is to be positioned above the vacuum cleaner exhaust outlet.

It is also to be appreciated that unlike prior noise mufflers of the cellular or porous surface type, which tend to become less efficient or completely useless with time as a result of the interstices in their surfaces becoming filled with debris, the noise filter of the invention remains fully effective with use and does not decrease in efficiency, inasmuch as it does not rely upon any cellular surface areas for its operation. In addition, while the muffler has been described for use in connection with a vacuum cleaner, it is understood that it would readily find application with other appliances utilizing high speed fans to move air, for example other types of floor care equipment and blowers.

While embodiments of the invention have been described in detail, various modifications and other embodiments thereof may be devised by one skilled in the art without departing from the spirit and scope of the invention, as defined by the appended claims.

What is claimed is:

1. In combination with an enclosure for connection with an exhaust outlet from an air blower, wherein said enclosure has means for exhausting air introduced therein, a sound reducing muffler comprising a housing having a cylindrical wall of a first diameter and planar end walls which extend from opposite circumferences of said cylindrical wall toward and perpendicular to the axis thereof and have circular openings of a second and smaller diameter formed therethrough coaxial with said axis of said cylindrical wall, and first and second tubular members of said second diameter, each connected at one end with a respective one of said planar end walls about the circumference of the opening therein to extend outwardly, but not inwardly, of said housing, an opposite end of said first tubular member being connectable with the exhaust outlet from the air blower to extend an opposite end of said second tubular member to interior of said enclosure for conveying air from the blower into said enclosure, said muffler acting as a low pass noise filter to reduce high frequency noises attending passage of air through the blower.

2. In the combination as in claim 1, wherein said muffler is substantially positioned within said enclosure.

3. In the combination as in claim 1 or 2, wherein said enclosure comprises a filter bag.

4. In the combination as in claim 1, wherein said muffler has at least two housings and at least three tubular members, said housings are spaced from each other along said muffler by a tubular member extending between facing openings in adjacent housings, and said muffler terminates at each end thereof in a tubular member extending outwardly from the opening in the housing thereat.

5. In the combination as in claim 1, wherein said enclosure is positioned above the exhaust outlet from the air blower and said opposite end of said second tubular member extends toward an upper portion of said enclosure to maintain the inlet to said enclosure above any collected debris therein so that said inlet does not become choked off with debris.

6. An improved filter bag of a type having an opening for connection with an exhaust outlet from an air blower and a sleeve therein connected in line with said opening for maintaining an inlet to said filter bag above any collected debris therein so that said inlet is not choked off with debris, wherein the improvement is characterized in that said sleeve comprises a housing having a cylindrical wall of a first diameter and planar end walls which extend from opposite circumferences of said cylindrical wall toward and perpendicular to the axis thereof and have circular openings of a second and smaller diameter formed therethrough coaxial with said axis of said cylindrical wall, and first and second tubular members of said second diameter, each connected at one end with a respective one of said planar end walls about the circumference of the opening therein to extend outwardly, but not inwardly, of said housing, an opposite end of said first tubular member being connected with the exhaust outlet to extend an opposite end of said second tubular member to the interior of the filter bag and above any collected debris therein, said sleeve operating as a low pass noise filter to muffle or reduce high frequency noises attending passage of air through the blower.

7. The improved filter bag as in claim 6, wherein said sleeve has at least two housings and at least three tubular members, said housings are spaced from each other along said sleeve by a tubular member extending between facing openings in adjacent housings, and said sleeve terminates at each end thereof in a tubular member extending outwardly from the opening in the housing thereat.

8. In combination with a vacuum cleaner having an exhaust outlet and an enclosure connected with said exhaust outlet for receiving debris laden air and for collecting the debris while allowing escape of air, a sound reducing muffler comprising a housing having a cylindrical wall of a first diameter and planar end walls which extend from opposite circumferences of said cylindrical wall toward and perpendicular to the axis thereof and have circular openings of a second and smaller diameter formed therethrough coaxial with said axis of said cylindrical wall, and first and second tubular members of said second diameter, each connected at one end with a respective one of said planar end walls about the circumference of the opening therein to extend outwardly, but not inwardly, of said housing, an opposite end of said first tubular member being connectable with said exhaust outlet to extend an opposite end of said second tubular member to interior of said enclosure for conveying debris laden air into said enclosure, said muffler acting as a low pass noise filter to reduce high frequency noises attending passage of air from said vacuum cleaner exhaust outlet.

9. In the combination as in claim 8, wherein said muffler is substantially positioned within said enclosure.

10. In the combination as in claim 8 or 9, wherein said enclosure comprises a filter bag.

11. In the combination as in claim 8, wherein said enclosure is positioned above said vacuum cleaner exhaust outlet and said opposite end of said second tubular member extends toward an upper end of said enclosure to maintain an inlet to said enclosure above collected debris therein so that said inlet does not become choked off with debris.

12. In the combination as in claim 8, wherein said muffler has at least two housings and at least three tubular members, said housings are spaced from each other along said muffler by a tubular member extending between facing openings in adjacent housings, and said muffler terminates at each end thereof in a tubular member extending outwardly from the opening in the housing thereat.

13. In the combination as in claim 1, wherein the attenuation in the level of sound passing through said muffler is expressed by the equation:

$$L = 10 \log [1 + \tfrac{1}{4}(m - 1/m)^2 \sin^2(kl)] \text{ dB, where:}$$

-continued $$m = \frac{\text{cross sectional area of said housing}}{\text{cross sectional area of said first tubular member}}$$

$l$ = length of said housing in feet $k = 2\pi/\lambda$ $$\lambda = \text{sound wavelength} = \frac{1130}{f}\sqrt{\frac{\theta_F + 460}{530}} \text{ feet}$$

$f$ = frequency of sound waves in Hz, and $\theta_F$ = temperature of said muffler in °F.

14. In the combination as in claim 6, wherein the attenuation in the level of sound passing through said sleeve is expressed by the equation:

$$L = 10 \log [1 + \tfrac{1}{4}(m - 1/m)^2 \sin^2(kl)] \text{ dB, where:}$$

$$m = \frac{\text{cross sectional area of said housing}}{\text{cross sectional area of said first tubular member}}$$

$l$ = length of said housing in feet $k = 2\pi/\lambda$

-continued $$\lambda = \text{sound wavelength} = \frac{1130}{f}\sqrt{\frac{\theta_F + 460}{530}} \text{ feet}$$

$f$ = frequency of sound waves in Hz, and $\theta_F$ = temperature of said sleeve in °F.

15. In the combination as in claim 8, wherein the attenuation in the level of sound passing through said muffler is expressed by the equation:

$$L = 10 \log [1 + \tfrac{1}{4}(m - 1/m)^2 \sin^2(kl)] \text{ dB, where:}$$

$$m = \frac{\text{cross sectional area of said housing}}{\text{cross sectional area of said first tubular member}}$$

$l$ = length of said housing in feet $k = 2\pi/\lambda$ $$\lambda = \text{sound wavelength} = \frac{1130}{f}\sqrt{\frac{\theta_F + 460}{530}} \text{ feet}$$

$f$ = frequency of sound waves in Hz, and $\theta_F$ = temperature of said muffler in °F.

* * * * *